US009992569B2

(12) United States Patent
Terpstra

(10) Patent No.: US 9,992,569 B2
(45) Date of Patent: Jun. 5, 2018

(54) CAMERA-MOUNTABLE ACOUSTIC COLLECTION ASSEMBLY

(71) Applicant: Paul D. Terpstra, Janesville, WI (US)

(72) Inventor: Paul D. Terpstra, Janesville, WI (US)

( * ) Notice: Subject to any disclaimer, the term of this patent is extended or adjusted under 35 U.S.C. 154(b) by 339 days.

(21) Appl. No.: 14/292,157

(22) Filed: May 30, 2014

(65) Prior Publication Data

US 2015/0350768 A1 Dec. 3, 2015

(51) Int. Cl.
*H04R 1/34* (2006.01)
*H04R 1/40* (2006.01)

(52) U.S. Cl.
CPC ..... *H04R 1/342* (2013.01); *H04R 1/406* (2013.01); *H04R 2499/11* (2013.01)

(58) Field of Classification Search
CPC ..... G10K 11/28; G10K 11/08; G10K 11/24; H04R 1/345; H04R 1/342; H04R 5/02; H04R 1/26; H04R 1/403
See application file for complete search history.

(56) References Cited

U.S. PATENT DOCUMENTS 2,017,122 A 10/1935 Hanson
2,049,586 A * 8/1936 Hanson ..... H04R 1/342 381/160
2,228,024 A 1/1941 Abrahams
3,483,940 A 12/1969 Weisenthal
3,723,962 A 3/1973 Hotchner
3,881,056 A 4/1975 Gibson
3,895,188 A * 7/1975 Ingraham ..... G10K 11/08 367/104
4,037,052 A * 7/1977 Doi ..... H04R 1/34 381/160
4,264,790 A 4/1981 Zlevor
4,286,642 A * 9/1981 Keatley ..... F16F 1/36 29/453
D324,219 S 2/1992 Besasie
D356,090 S 3/1995 Russell
5,420,762 A 5/1995 Lewis
5,452,364 A 9/1995 Bonham
5,548,656 A * 8/1996 Weisel ..... H04R 29/001 381/122
6,069,958 A * 5/2000 Weisel ..... H04R 3/005 381/122
6,408,080 B1 6/2002 Koizumi
7,708,440 B2 5/2010 Hamada et al.
8,169,375 B1 5/2012 Conrad
2004/0114778 A1 6/2004 Gobeli
2007/0183607 A1 8/2007 Andrews et al.
(Continued)

OTHER PUBLICATIONS

Big Ears Parabolic Reflector; Retrieved on Apr. 19, 2013; Canford.co.uk; Retrieved from the Internet: http://www.canford.co.uk/ProductResources/ig/2596.pdf.
(Continued)

*Primary Examiner* — Matthew Eason
*Assistant Examiner* — Taunya McCarty
(74) *Attorney, Agent, or Firm* — Johnson Legal PLLC

(57) ABSTRACT

An acoustic collection and collection assembly comprises an acoustic collection dish, a support frame, and a microphone mount extending from the support frame that allows one or more microphones to be positioned at the acoustic focal point of the dish for optimal capture of distant sounds.

12 Claims, 13 Drawing Sheets

(56) References Cited

U.S. PATENT DOCUMENTS

| | | | | |
|---|---|---|---|---|
| 2011/0226545 | A1* | 9/2011 | Richardson | H04B 1/3888 181/200 |
| 2012/0044374 | A1* | 2/2012 | Pohlert | H04N 5/2256 348/220.1 |

OTHER PUBLICATIONS

Broadcast Big Ears Products; Retrieved on Apr. 19, 2013; Parabs.com; Retrieved from the Internet: http://www.parabs.com/Broadcast/BroadcastBigEars.htm.

JonyShot Parabolic Microphone; 2007; JonyJib.com; Retrieved from the Internet: http://www.jonyjib.com/jonyshot.htm.

Morgan, Tim; The Parabolic Revolution; Oct. 2011; Ferroproductions.com; Retrieved from the Internet: http://www.ferroproductions.com/the-parabolic-revolution/.

* cited by examiner

CAMERA-MOUNTABLE ACOUSTIC COLLECTION ASSEMBLY

FIELD OF THE INVENTION

The present invention relates to an acoustic collection assembly that is suitable for use mounted on a handheld or stationary camera.

BACKGROUND OF THE INVENTION

Parabolic microphone systems, a general term denoting audio capture systems using a central microphone in front of a curved, rear reflector that may exhibit a wide variety of shapes but designed to concentrate and focus audio information at the microphone, have been used in a wide variety of circumstances by military, fire/rescue and broadcast companies. The benefits and advantages of concentrating sounds in a highly directional manner has become a common tool for remote reconnaissance, monitoring, assessment and lost sound capture. See U.S. Pat. Nos. 2,017,122; 2,049,586; 2,228,024; 3,483,940; 3,881,056; 4,037,052; 4,264,790; 5,452,364; and 6,408,080 the disclosures of which are hereby incorporated by reference. See also copending U.S. patent application Ser. No. 13/472,559 filed on May 16, 2012 entitled "Acoustically Isolated Parabolic Sound Pickup Assembly" the disclosure of which is also incorporated herein by reference.

Parabolic microphone assemblies can be found commercially from several vendors. The support designs of each fall into one of a limited number of categories. The first is a pole-mountable frame with a vertically-oriented cylindrical tube rigidly welded to a tubular frame with arms that extend around the back of the parabolic reflector and is secured to a planar lip formed around the perimeter of the reflector. A microphone mounting assembly extends across the front of the reflector between the support frame arms and is similarly secured to the lip of the reflector.

A second type of parabolic reflector support is based on a pair of vertically-oriented, tubular handles with a pair of arms extending from the vertical handle. Each arm is secured to a point on the lip of the reflector so an operator must use both hands to support and aim the reflector to capture the desired sounds. The microphone support extends across the front of the reflector and attaches to the lip of the reflector at a location intermediate the points of attachment for each handle.

A third type of parabolic reflector support is intended for handheld support and aiming. One such type of device uses a single handgrip at the rear of the reflector from which the microphone assembly extends into the parabolic field through a hole in the reflector.

In most of the embodiments, the device is designed for larger, commercial events where broadcast-quality sound is important and the venue can justify the employment of an audio engineer to monitor sound collection and quality. There exists a need, though, for smaller devices that can be mounted on a handheld 35 mm or video camera for simultaneous operation by the videographer. The sound quality and strength remain just as important, but the circumstances may not afford the space or opportunity for a separate audio engineer.

SUMMARY OF THE INVENTION

It is an object of the invention to provide a camera-mountable acoustic reflector and collection assembly that can deliver highly focused, high quality sounds from a distance.

It is a further object of the invention to provide a portable acoustic reflection assembly that can be readily transported without disassembly.

It is an additional object of the invention to provide a compact sound reflection and collection assembly whose connections are acoustically isolated from frame and/or microphone supports to minimize extraneous sounds from the assembly while recording a desired sound.

In accordance with these and other objects of the invention that will become apparent from the description herein, an acoustic reflector and collection assembly according to the invention comprises (a.) a generally parabola-shaped sound reflector exhibiting a peripheral lip at a front of said reflector that extends radially outwardly in a first plane around at least a major portion of the front of said reflector, said lip exhibiting at least first, second and third attachment sites; and (b.) a generally planar, rigid, support frame, said frame dimensioned to align first, second and third attachment openings in said frame with corresponding attachment sites on said peripheral lip, said frame further comprising a centrally located microphone mount at substantially the geometric center of the front of said reflector, said frame being supported by one or more arms of said support frame that extend radially inwardly from said frame to the centrally located microphone mount.

The acoustic assembly according to the invention provides professional and amateur videographers with a sound reflection and collection assembly that provides a high sound quality in a focused collection that is at least substantially free of extraneous sounds from the collection assembly. By changing the mounting adapter on the support frame, the same reflector assembly can be used on a wide variety of recording equipment, stands, and mounting locations.

DETAILED DESCRIPTION OF THE INVENTION

Figure 1:
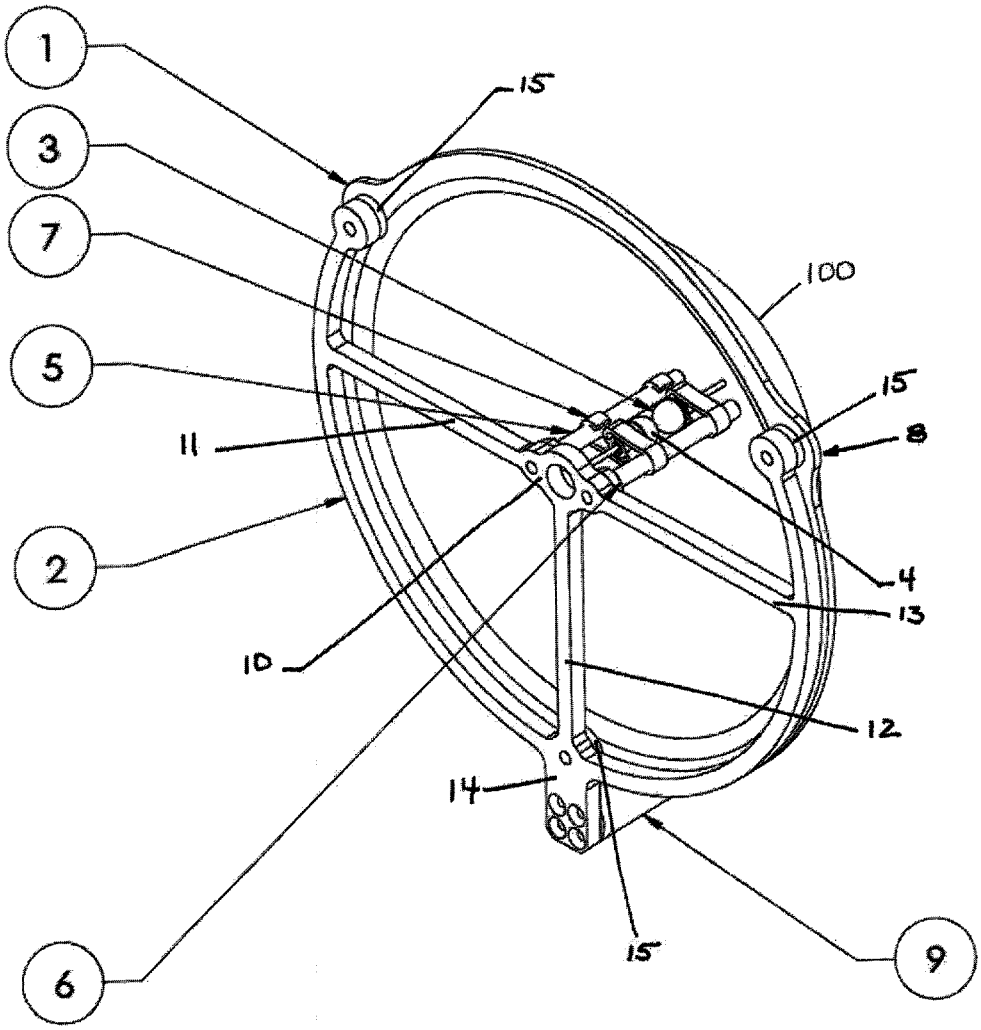
FIG. 1 shows an isometric view of an acoustic reflector according to the invention with a shotgun mount adapter secured to the support frame.

Acoustic collection systems according to the invention use an acoustic collection dish, a support frame, and a microphone mount extending from the support frame that allows one or more microphones to be positioned at the acoustic focal point of the dish for optimal capture of distant sounds. The collection dish may exhibit a variety of shapes depending on the distance and scope of sounds to be captured. Preferably, the collection dish used in the present invention exhibits a parabolic or substantially parabolic shape for precise capture of distant sound with an outwardly extending lip around substantially the entire perimeter of the dish.

The outwardly extending lip of the acoustic collection dish serves to reinforce the dish to reduce flexural stresses while also providing a convenient site for external attachments. Preferably, the external support frame provides support for at least half of the perimeter of the collection dish and even more preferably the frame provides external support for a majority of the dish lip perimeter.

An external support frame is used in the present assembly for the purposes of supporting the collection dish, providing a centrally-located attachment surface the pickup microphones, and a mounting lip or extension for attaching the assembly to a camera, stand or microphone boom device. Preferably, the external support frame is connected to the lip of the collection dish in at least two, and preferably three or more locations within inwardly-extending arms that meet in a centrally-located mounting site for one or more microphones. Even more preferably, the collection lip has a plurality of openings through the lip that align with threaded openings in the support frame that receive threaded fasteners extending through the dish lip and support the dish by compression from the head of the fastener on the threads of the support frame. Such a structural arrangement permits the use of resilient, acoustic isolation washers or bushings between the support frame and the lip and between the lip and the head of the threaded fastener. Indeed, the use of resilient, acoustic isolation washers or bushings at most, if not all, of the connections in the present assembly are useful to reduce the generation of creaks, groans and miscellaneous sound vibrations that could be transmitted along the assembly and become captured by the microphones.

Any type of support can be used to hold the microphones at substantially the focal point within the collection dish. In general, the microphone support connects to the centrally-located portion of the support frame that extends across the collection dish and extends inwardly towards the acoustic focal point of the dish. The microphone support should provide adjustability in the depth of the location into the dish to position the microphone or microphones as close as possible to the desired acoustic focal point for the dish.

The number of microphones can vary depending the size of the microphones and the desired sound level. At least one microphone is needed to capture sound. Two microphones may be positioned in opposition directions to place the receiving portion of each microphone at the acoustic focal point. If the microphones are sufficiently small, up to four or five microphones can be so positioned in three dimensions around the acoustic focal point.

The preferred microphone support system positions two lavalier-type microphones head-to-head between two parallel rails that extend inwardly into the dish from the centrally-located connection site of the support frame. The rails or arms are preferably threaded to screw into correspondingly threaded openings in the centrally-located site of the support frame and tighten with jam nuts on each rail.

One or more, preferably 1-4, microphones can be placed at substantially the focal point of the parabolic reflector for enhanced sound quality signal of the captured sounds. Multiple microphones on the assembly, one spaced axially from the acoustic focal point, can also be used to provide a separate sound cancellation signal to clean up the sound captured by the microphone at substantially the acoustic focal point.

One or more microphone retention brackets are used to hold the one or more microphones in position on the support frame with a frictional, mechanical or fastener-based fit. The microphone retention brackets may take a variety of shapes. For example, one may use an S-shaped, double-S, section-symbol-shaped, H-shaped, or double-curved clip that extends between each support rail and provides a mount that will hold a microphone at a desired location between the support rails. The mounting bracket preferably exhibits a friction fit with each support rail to allow axial adjustment of the microphone position into and out of the dish for proper placement of the microphone about the acoustic focal point. If desired, a set screw or similar mechanical tightening system may be added to help secure each microphone in position.

The external lip of the reflector is also a convenient place to install one or more lamps for illumination of a subject. See FIGS. 11-13. Preferably, light emitting diodes or a circular fluorescent lamp are disposed around the parabolic reflector and are directed forward from the reflector to illuminate a subject in front of the camera. The power supply can be mounted anywhere provided that the weight of the connections or power supply are convenient.

The invention is conveniently described with reference to the attached figures. Similar structures in the figures are noted with the same reference number.

As shown in FIG. 1, the substantially planar, circumferential lip 1 of an acoustic reflector dish 100 that preferably exhibits a parabolic or substantially parabolic shape and is supported by the correspondingly substantially planar support frame 2. One or more microphones 3, 4 are preferably microphones, such as lavaliere or similar, and are preferably mounted at substantially the acoustic focal point of the reflector dish. Two such microphones are preferably mounted in opposing directions to place their respective front ends in adjacent positions so that both microphones are able to receive focused sounds for a greater overall sound level. Three or four microphones may be mounted from the top or bottom so that the input ends are located at substantially the acoustic focal point.

Microphones 3, 4 are supported within the acoustic reflector by mounting rails 5 that extend into the reflector from support frame 2. S-shaped or section-symbol-shaped mounting clips 7 that connect to each of rails 5 and provide a central mounting point between them where microphone 3, 4 can be attached and secured. As shown, the proximal end of each of mounting rails 5 exhibits a threaded end and hex jam nut 6 that allows rails 5 to be removably secured to and tightened onto a central mounting region 10 on frame 2 among frame supports 11, 12, 13. An outwardly extending frame flange 14 that is opposite support 12 provides an extended surface to which a variety of mounting adapters can be secured. Flange 14 can take a variety of geometric shapes but is preferably rectangular. As shown, four fasteners through flange 14 extend into a cylindrical shotgun mount connector 9 to provide a secure connection without rotation around connector 9 without also rotating connector 9. It is possible, however, that support frame 2 can be rotated within the plane of lip 1 so that extension 14 is positioned between adjacent frame supports 11, 12, 13. As shown in FIG. 1, a shotgun mounting connector 9 can be secured to flange 14 with screws (as shown) or virtually any other type of fastener, quick connect, wing nut or the like.

Circumferential lip 1 is removably secured to support frame 2 in three locations to provide a support plane. Fasteners 8 such as button head cap screws or thumb screws that extend into frame 2 can be used to secure lip 1 to frame 2. As shown, support frame 2 extends at least halfway around the circumference of lip 1 but may also extend up to the full 360° of perimeter lip 1. The degree and extend of the size of support frame 2 around lip 1 is limited only by sufficiency of support for lip 1, weight, and resistance to torsional forces.

Preferably, support frame 2 is made of a lightweight, substantially rigid material that is capable of providing a substantially unyielding support plane to reduce torsional stresses and movement between frame 2 and lip 1 of the reflector dish. A reduction of such relative movement will help reduce creaks, groans and squeaks in the support assembly that can be transmitted to the supported microphones as undesired, extraneous sound that adversely affects the quality of the reflected and captured sounds.

Further reductions in extraneous sound can be accomplished by the use of isolation washers 15 between one or more, preferably substantially all, of the connections in the assembly. See FIGS. 3, 5, 6 and 12 that show a spatial gap between lip 1 and frame 2. Suitable isolation washers 15 are preferably made of a resilient silicone or rubber material that is capable of damping minor vibrations while also providing a secure connection.

In one embodiment, the microphone support mounts connect with frame 2 by way of releasable, snap fit connectors that are preferably acoustically isolated from frame 2 to provide convenient removal of pre-mounted microphones. Support frame 2 may then remain connected to lip 1 of the parabolic dish continuously and require only changes to the adapter connected to extension 14 and re-attachment of the microphones.

Figure 2:
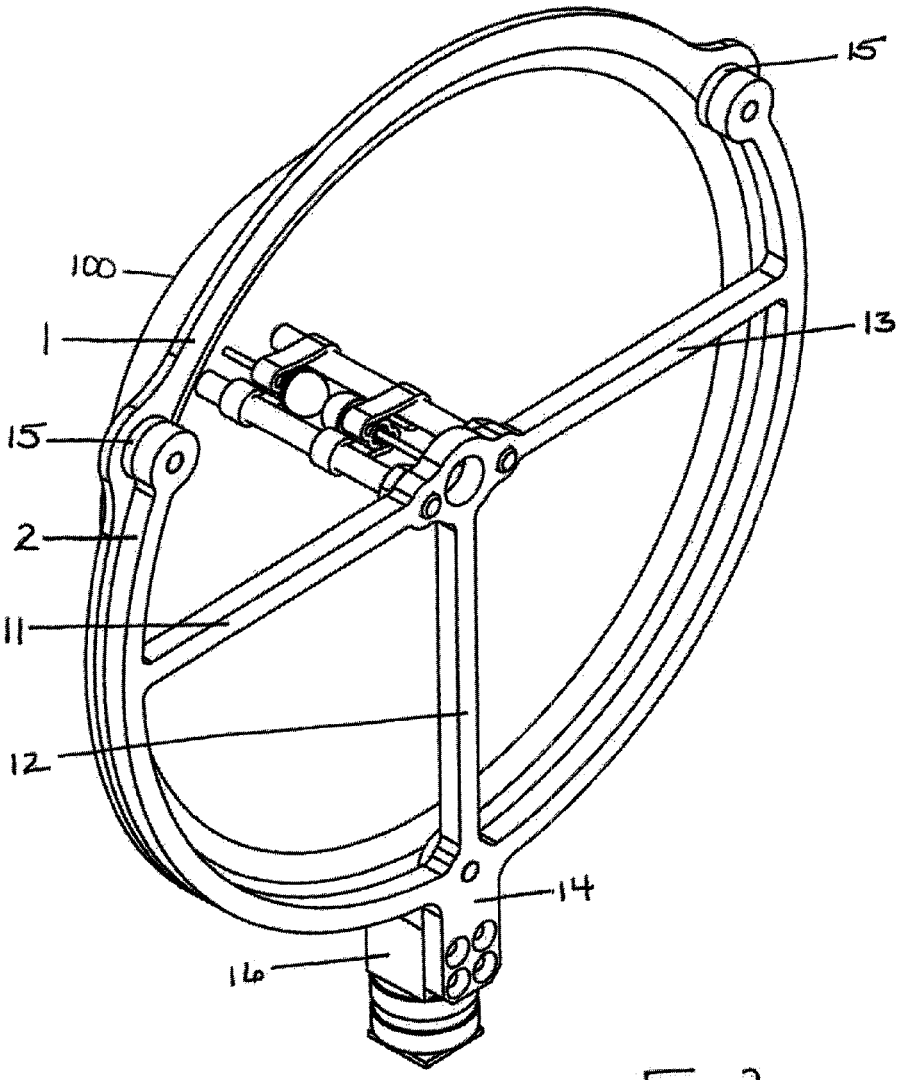
FIG. 2 illustrates a view of the acoustic reflector assembly with a camera hot shoe mount adapter secured to the support frame.
Figure 3:
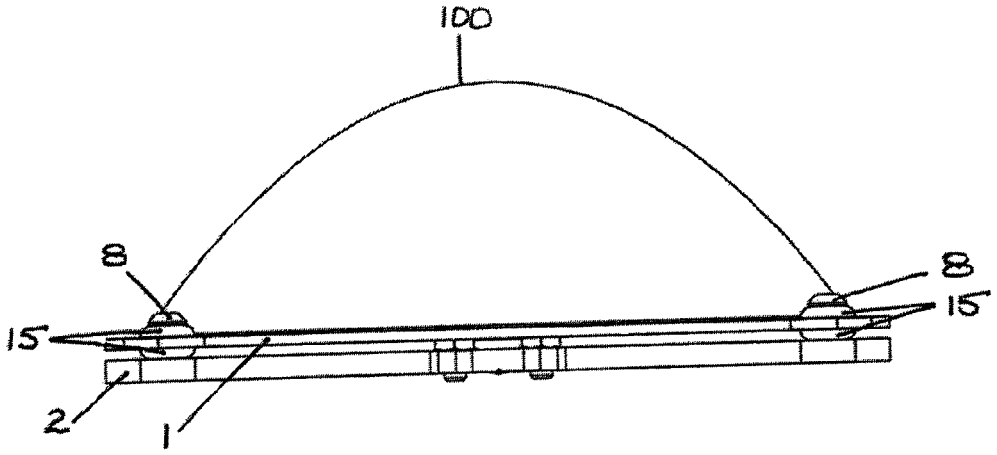
FIG. 3 is a top view of the acoustic reflector assembly.
Figure 4:
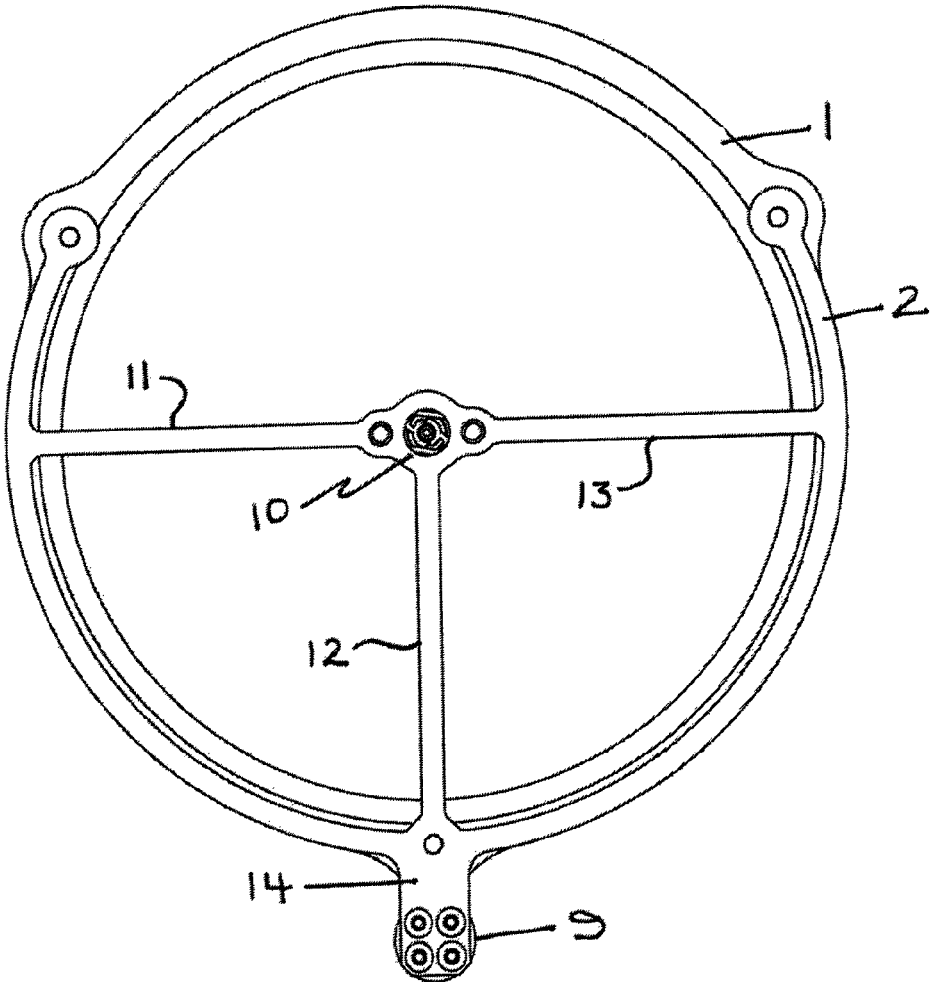
FIG. 4 is a front view of the assembly shown in FIG. 1.
Figure 5:
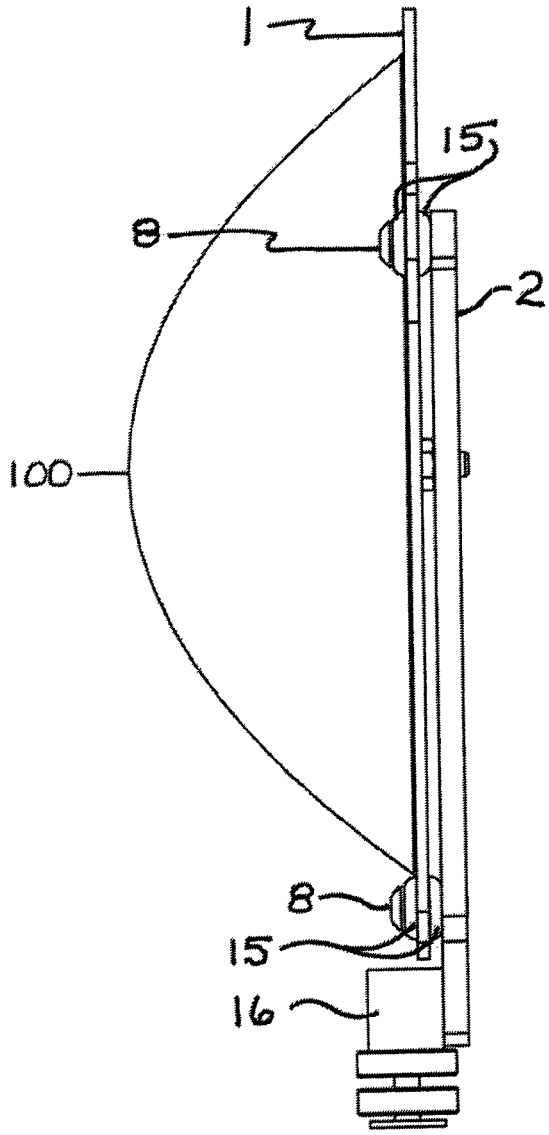
FIG. 5 is a side view of the reflector assembly shown in FIG. 2.
Figure 6:
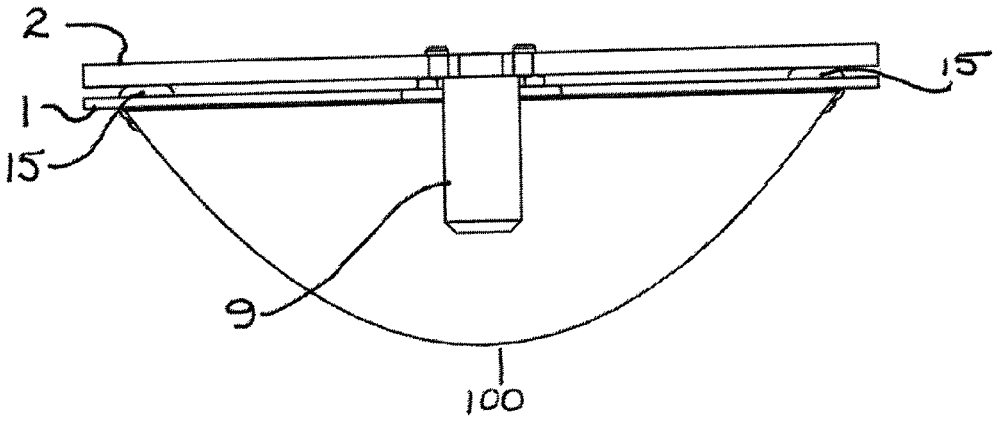
FIG. 6 is a bottom view of the assembly shown in FIG. 1.
Figure 9:
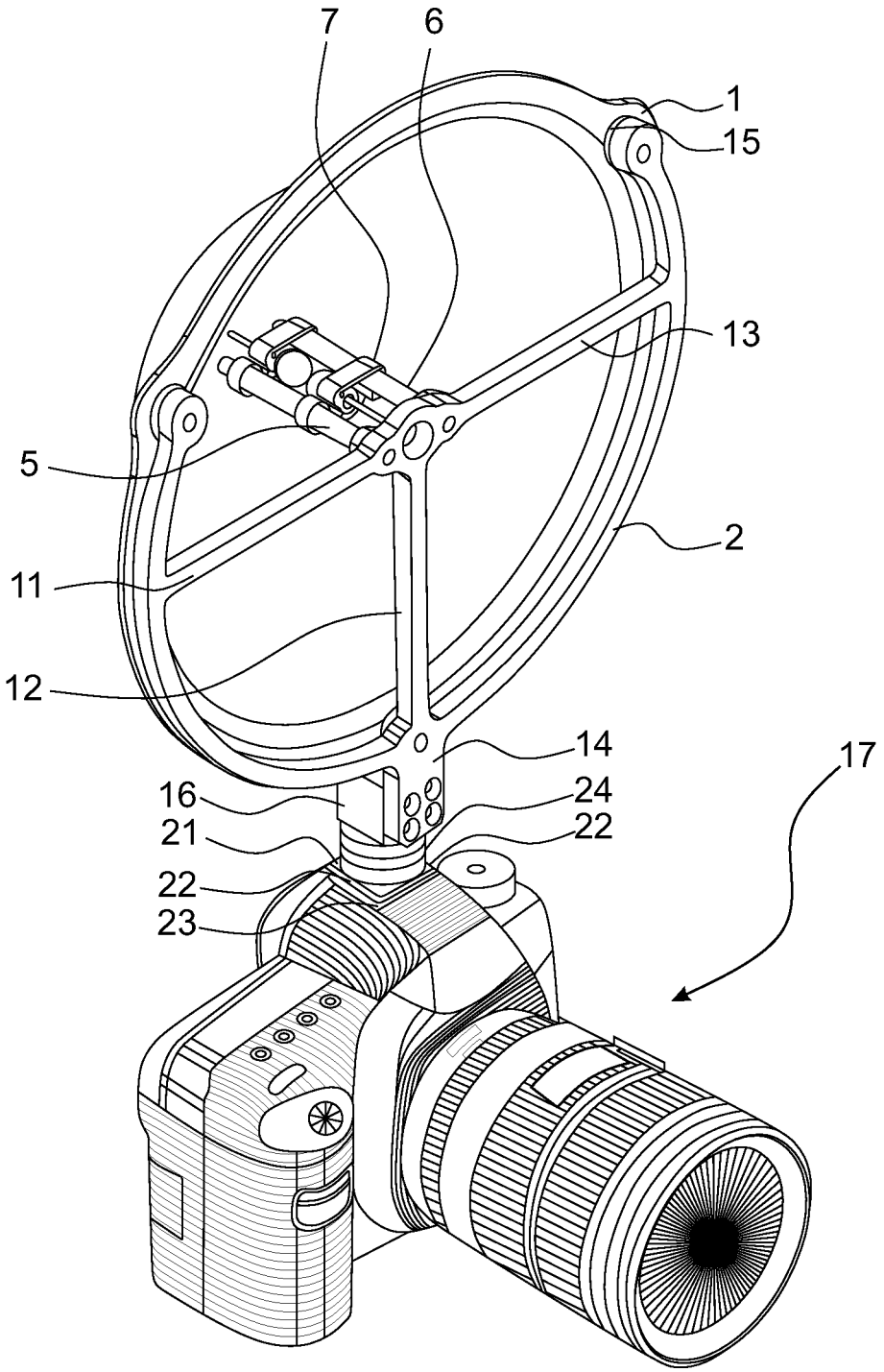
FIGS. 9-10 illustrate the acoustic reflector mounted on a handheld camera using the hot shoe mount adapter.
Figure 10:
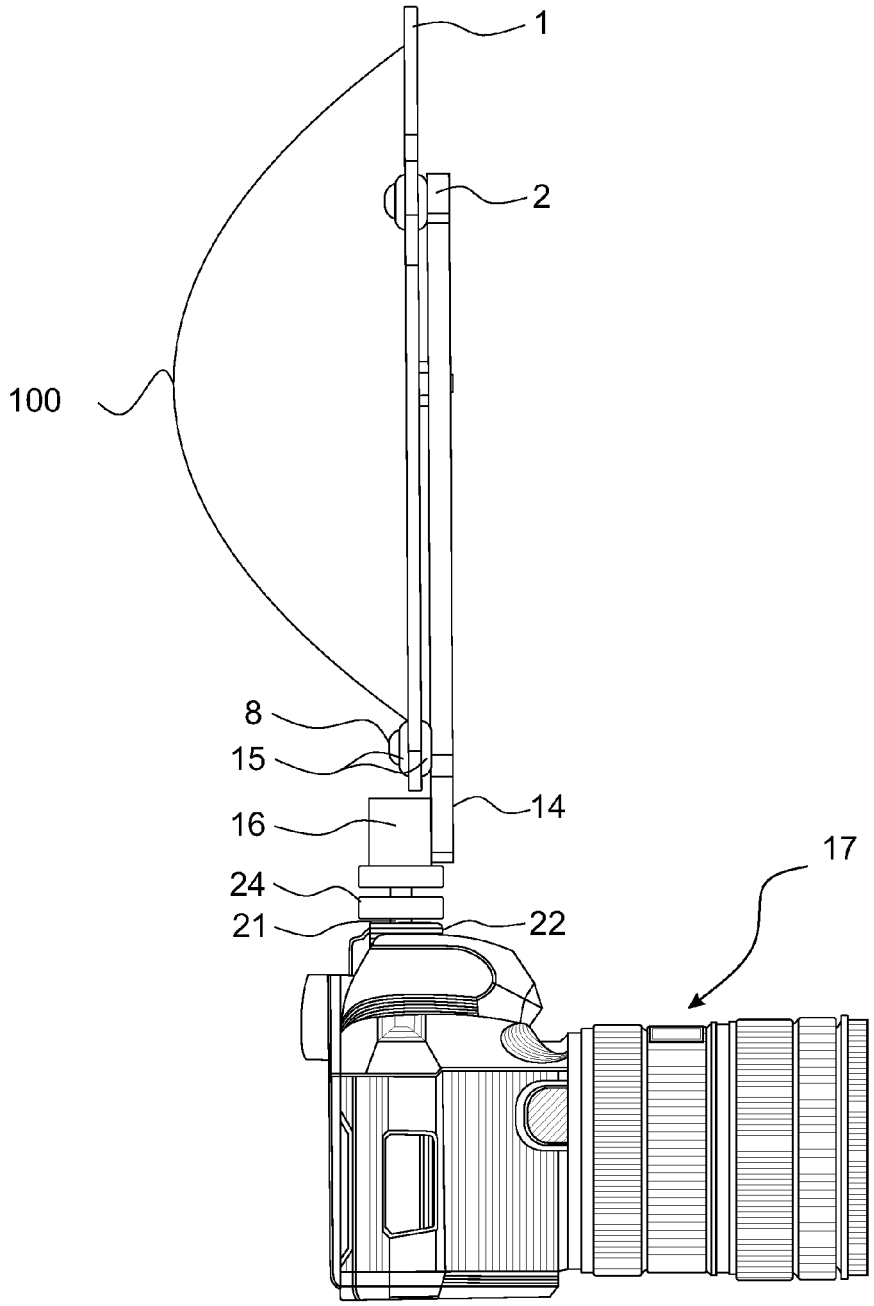

FIG. 2 is substantially the same as FIG. 1 but shows the use of camera hot shoe adapter 16 secured to frame extension 14. The hot shoe adapter screws into an appropriately tapped hold, preferably ¼-20, in the square block at the bottom of the mounting flange. See also FIGS. 9 and 10 showing the acoustic reflector assembly of the invention mounted on a handheld digital, single lens reflex (SLR) type camera 17 for capturing high quality audio in videos captured by this type of small camera. The hot shoe adapter can be removed to mount the acoustic reflector assembly to a tripod, monopod, or extension arm with a corresponding ¼-20 threaded stud.

Figure 7:
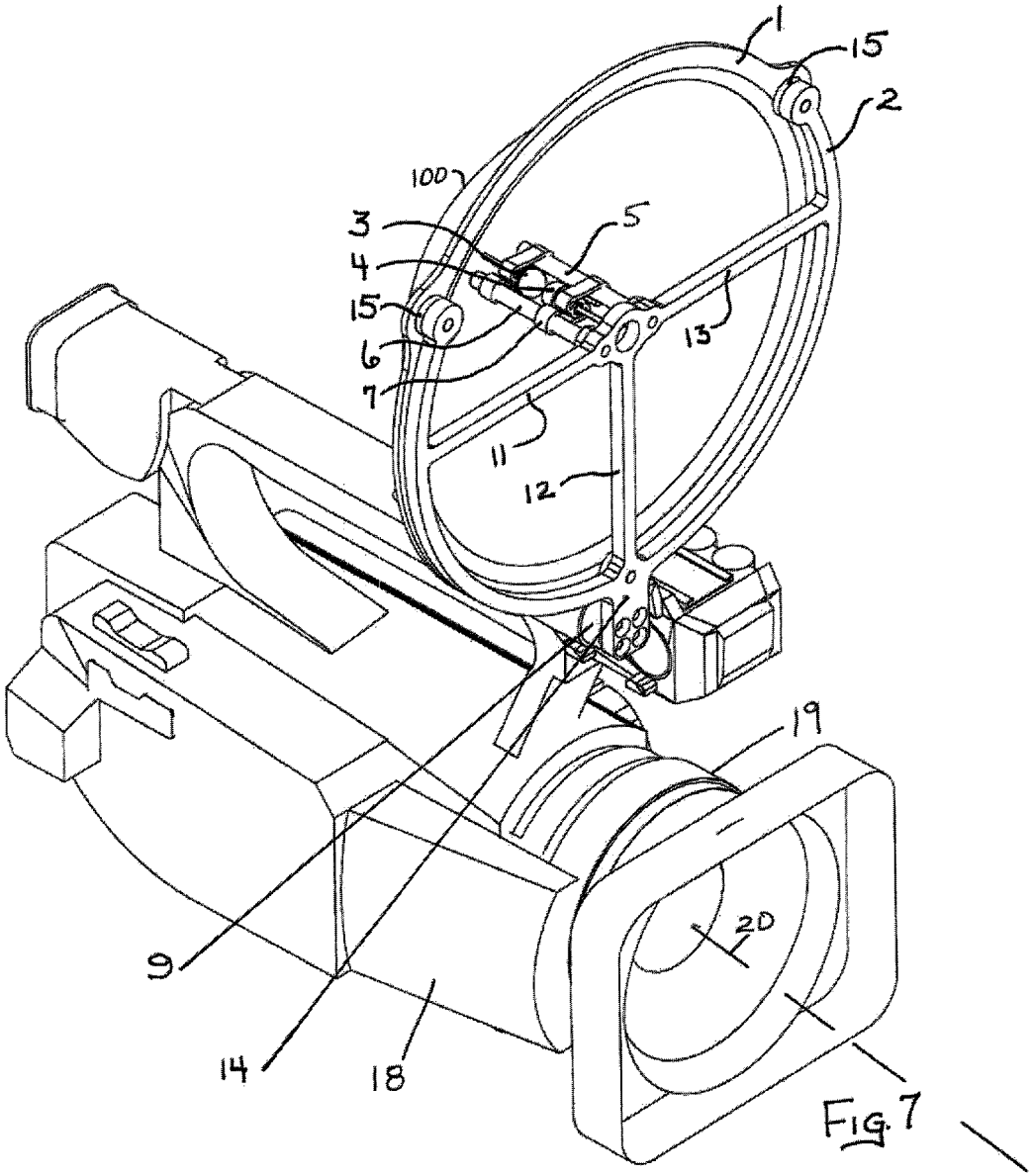
FIGS. 7-8 show the acoustic assembly of the invention mounted on a video camera using the shotgun adapter.
Figure 8:
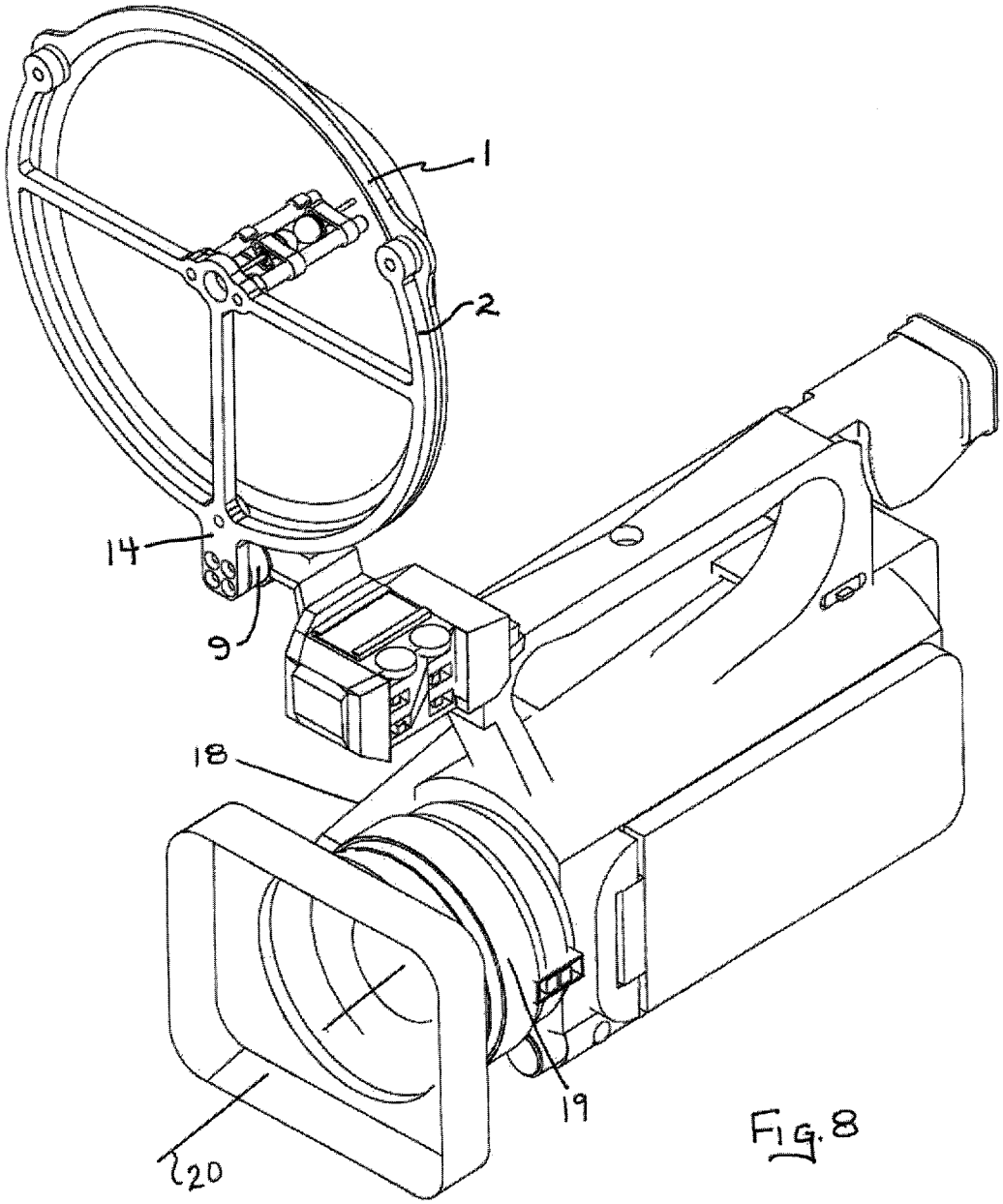

FIGS. 7 and 8 depict an acoustic collection assembly according to the invention mounted on a video camera 18 with a shotgun mount connection 9. The acoustic assembly is thus disposed above camera 18 and along the focal axis 20 of camera lens 19 so that the acoustic assembly collects sounds from the direction where the lens points.

As noted above, FIGS. 9 and 10 illustrate the acoustic assembly of the present invention when mounted on a digital single lens reflex camera 17 or similar camera with the capability of recording video and exhibiting a hot shoe mount 21 that will mate with a hot shoe adapter 16 on the acoustic assembly. Hot shoe mount 21 typically includes a pair of opposing C-shaped flanges 22 that are intended to receive a device mounting plate 23 therebetween. A threaded screw 24 then tightens down into the inwardly extending, upper surfaces of flanges 22.

Figure 11:
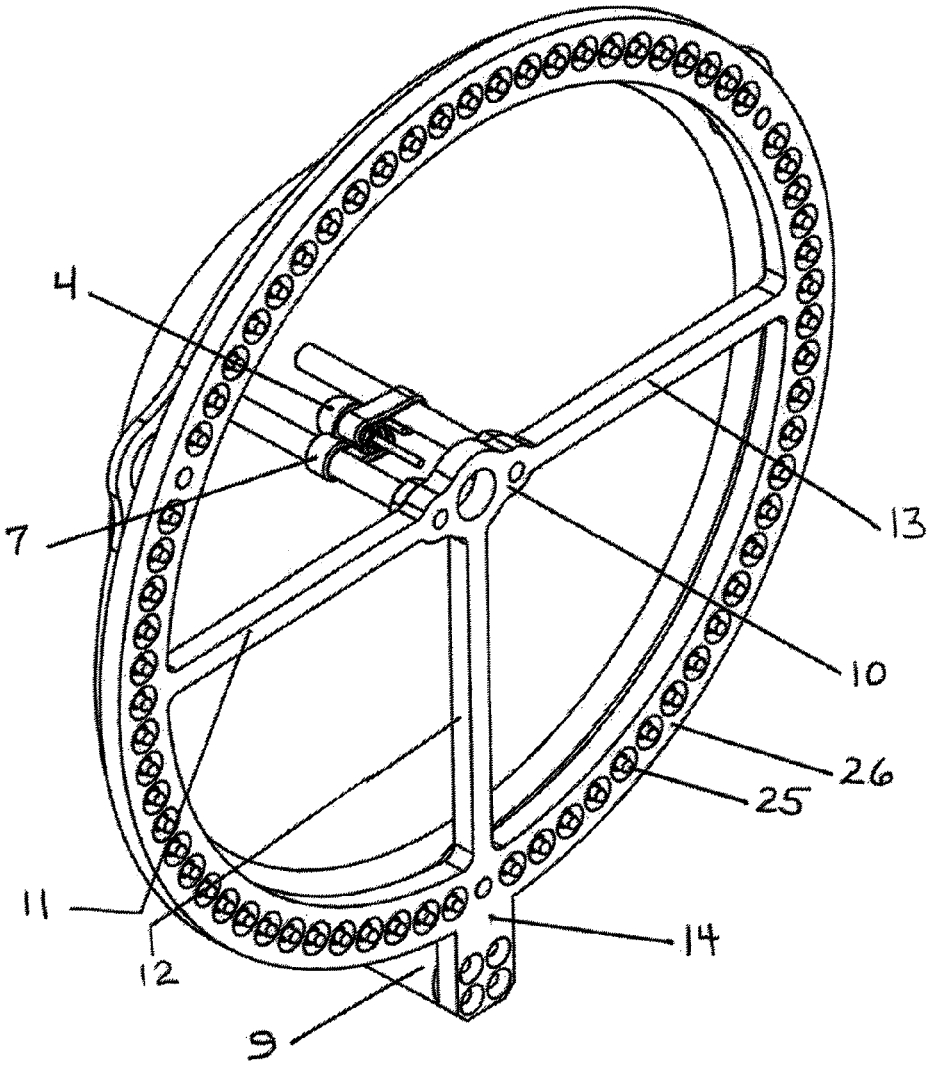
FIGS. 11-13 depict an embodiment wherein a series of LED lamps are associated with a frame for the acoustic reflector.
Figure 12:
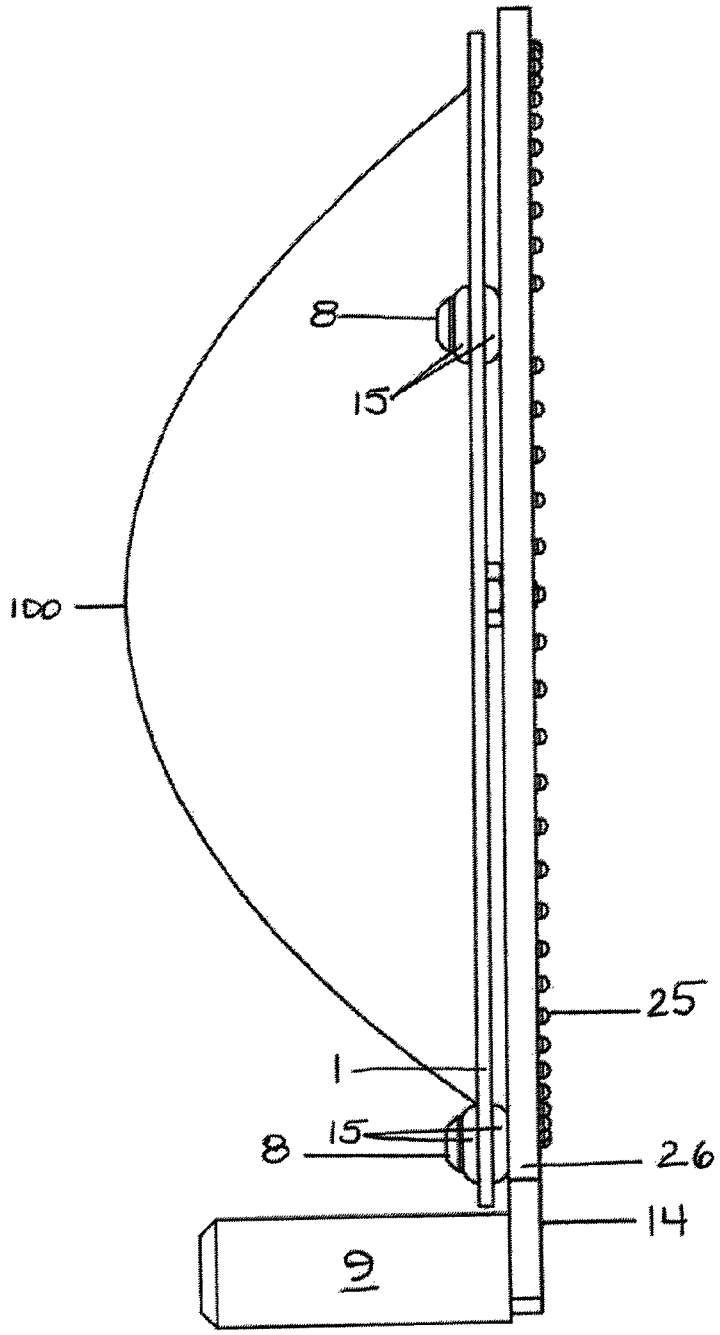
Figure 13:
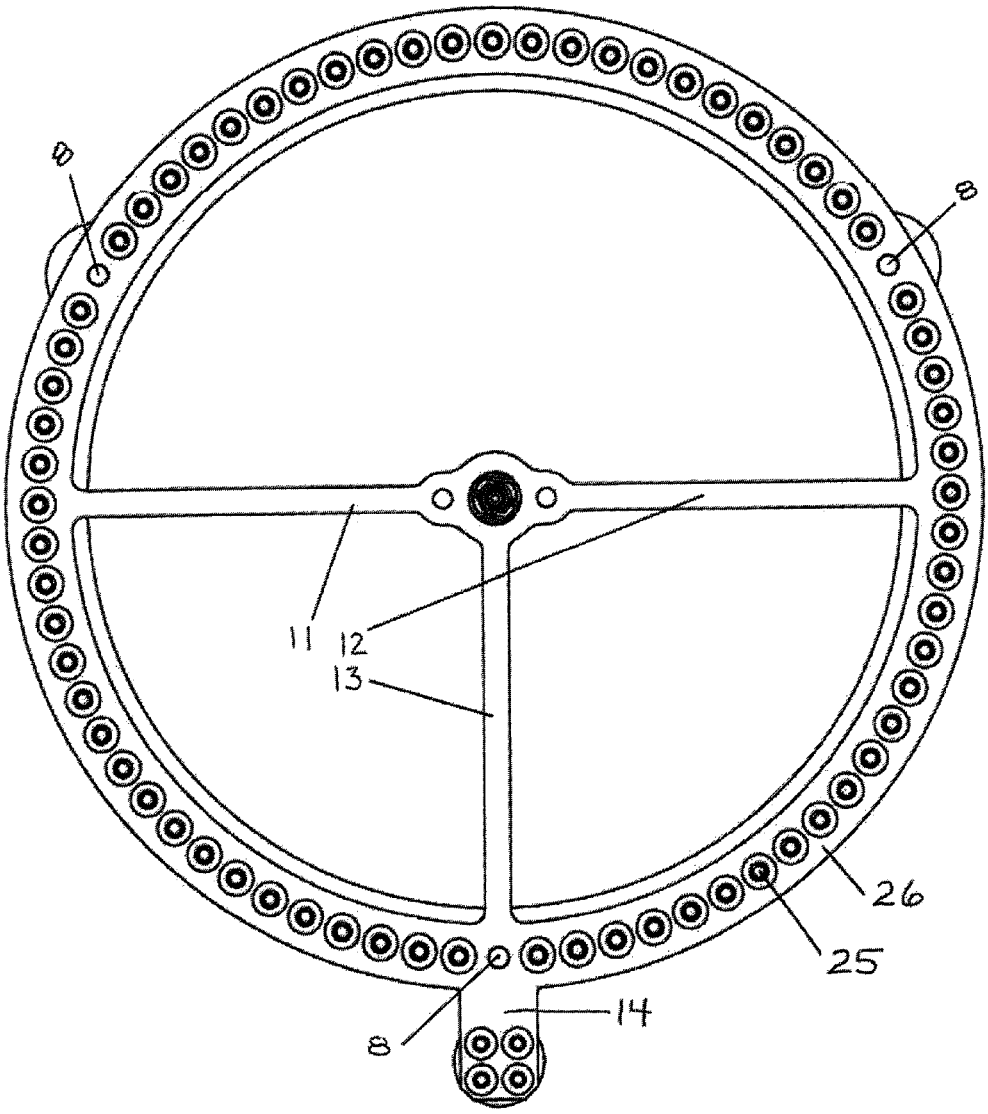

FIGS. 11-13 illustrate an acoustic collection assembly having an array of lamps, preferably light emitting diodes (LEDs) 25 associated with frame 26 that extend around the entirety of lip 1 and face in the open direction of the acoustic reflector dish. Frame 26 thus serves as both a support for the acoustic assembly and as a heat sink for the LED array. A power connection (not shown) is used with an external power source, such as an external battery, to provide power to LEDs 25 for illumination. Frame 26 is acoustically isolated from acoustic collector 1 with isolation bushings 15 around fasteners 8.

It will be understood that the figures and illustrations presented herein are intended to assist in an understanding of the invention and not act as a limitation on the scope of the appended claims.

What is claimed is:

1. An acoustic reflector assembly comprising:

a. a generally parabola-shaped sound reflector comprising: (i) a circumferential lip at a front of said reflector that extends radially outwardly in a first plane around at least a major portion of the front of said reflector, said lip having a plurality of attachment sites; and (ii) an acoustic focal point;

b. a generally planar, rigid, support frame in a plane, said frame dimensioned to align attachment openings in said frame with corresponding attachment sites on said circumferential lip of said parabola-shaped sound reflector, said frame further comprising (i) a centrally-located microphone mount at substantially the acoustic focal point of said reflector and (ii) said frame integrally forming said one or more support arms that each extend inwardly from said circumferential lip to said centrally-located microphone mount, said microphone mount being supported by one or more of said support arms and wherein acoustically-isolated fasteners connect said generally parabola-shaped sound reflector to said support frame at each of said attachment sites; wherein said microphone mount comprises a pair of support rails that extend from said plane into and towards the rear of said reflector; and wherein said microphone mount further comprises a mounting clip extending between each of said support rails and into which a microphone can be secured.

2. An acoustic reflector assembly according to claim 1 wherein said support frame has three support arms.

3. An acoustic reflector assembly according to claim 1 wherein said support frame further has an outwardly extending mounting flange.

4. An acoustic reflector assembly according to claim 3 wherein a camera hot shoe adapter is removably connected to said flange.

5. An acoustic reflector assembly according to claim 3 wherein a shotgun mount is removably connected to said flange.

6. An acoustic reflector assembly according to claim 1 wherein said microphone is secured at substantially said acoustic focal point of said reflector.

7. An acoustic reflector assembly according to claim 1 wherein each support rail comprises a rod that is threaded at one end.

8. An acoustic reflector assembly according to claim 1 wherein each rail in said pair of support rails is secured to said support frame with an acoustically-isolated connection.

9. An acoustic reflector assembly according to claim 1 wherein each rail in said pair of support rails is connected to said support frame with a threaded connection.

10. An acoustic reflector assembly according to claim 1 wherein two microphones are mounted within said sound reflector on an axis of said reflector.

11. An acoustic reflector assembly according to claim 10 wherein one of said microphones is mounted at substantially an acoustic focal point of said sound reflector, and the second of said microphones is mounted on an axis of said reflector but not at said focal point.

12. An acoustic reflector assembly according to claim 1 further comprising illumination lamps associated with said frame.

* * * * *